US005658663A

United States Patent [19]

Mizuno et al.

[11] Patent Number: 5,658,663

[45] Date of Patent: Aug. 19, 1997

[54] VINYLIDENE FLUORIDE RESIN FIBER AND PROCESS FOR PRODUCING THE SAME

[75] Inventors: Toshiya Mizuno; Seiichi Ohira, both of Tsuchiura; Mitsuru Itoh; Kazuyuki Munakata, both of Iwaki; Satoshi Hashimoto, Ibaraki-ken, all of Japan

[73] Assignee: Kureha Kagaku Kogyo Kabushiki Kaisha, Japan

[21] Appl. No.: 563,055

[22] Filed: Nov. 27, 1995

[51] Int. Cl.$^6$ ..... D02G 3/00; C08F 4/00

[52] U.S. Cl. ..... 428/364; 428/394; 525/255

[58] Field of Search ..... 428/364, 394; 525/255

[56] References Cited

U.S. PATENT DOCUMENTS

| | | | |
|---|---|---|---|
| 4,052,550 | 10/1977 | Chion et al. | 526/255 |
| 4,302,556 | 11/1981 | Endo et al. | 526/255 |
| 4,546,158 | 10/1985 | Mizuno et al. | 428/364 |
| 4,564,013 | 1/1986 | Lilenfeld et al. | 128/335.5 |
| 4,667,001 | 5/1987 | Mizuno | 526/255 |
| 4,670,527 | 6/1987 | Mizuno | 526/255 |
| 4,833,027 | 5/1989 | Ueba et al. | 428/364 |
| 5,238,739 | 8/1993 | Susa et al. | 428/364 |

*Primary Examiner*—Newton Edwards

*Attorney, Agent, or Firm*—Nixon & Vanderhye

[57] ABSTRACT

A vinylidene fluoride resin fiber have a diameter of not less than 0.5 mm, and satisfy the formulae (1) and (2):

$$Ra \geqq 0.5 \quad (1)$$

$$Rb \geqq (Ra+Rc)/3.0 \quad (2)$$

wherein Rc represents a ratio of absorbance at 765 $cm^{-1}$ of α-type crystal to that at 843 $cm^{-1}$ of β-type crystal at the center point of a fiber cross-section, Rb represents a ratio of absorbance at 765 $cm^{-1}$ of α-type crystal to that at 843 $cm^{-1}$ of β-type crystal at the point of r/3 from the center point thereof, and Ra represents a ratio of absorbance at 765 $cm^{-1}$ of α-type crystal to that at 843 $cm^{-1}$ of β-type crystal at the point of 2r/3 from the center point thereof, wherein r is a radius of the fiber cross-section.

7 Claims, No Drawings

VINYLIDENE FLUORIDE RESIN FIBER AND PROCESS FOR PRODUCING THE SAME

BACKGROUND OF THE INVENTION

The present invention relates to a vinylidene fluoride resin fiber and a process for producing the fiber. The vinylidene fluoride resin fiber according to the present invention is useful for fishery materials, particularly for fishlines used for landing weighty fishes such as tuna.

Vinylidene fluoride resin fibers have been popularly used for fishery materials such as fishlines and fishing nets as this fiber has a refractive index close to that of water and tends to be concealed from the view in water.

A fiber used for landing weighty fishes such as tuna is required to have a significantly large diameter such as not less than 0.5 mm, but it is not enough to merely enlarge the fiber diameter for catching weighty fishes.

In the case of tuna, for instance, it is said that when the fish takes the bait, it makes a nose-dive in water at a speed of around 60 km/h, giving a sharp impact force to the fiber, Therefore, the fiber used for catching weighty fishes is required to meet certain specific quality requirements, that is, it is required, for instance, to be capable of landing fishes with no fear of snapping even when given a strong impact force such as mentioned above, and yet to have good handling property.

As a result of-the present inventors' intensive studies on the subject matter, it has been found that by melt-spinning a feedstock resin, cooling the spun filament at a specified temperature and preheating the resultant filament at a specified temperature before stretching, the obtained vinylidene fluoride fiber has an excellent transparency, high tensile elongation and tensile strength, and a high energy at break. The present invention has been attained on the basis of the above finding.

SUMMARY OF THE INVENTION

The object of the present invention is to provide a vinylidene fluoride resin fiber which can be advantageously used in landing weighty fishes such as tuna To accomplish the aim, in a first aspect of the present invention, there is provided a vinylidene fluoride resin fiber having a diameter of not less than 0.5 mm, and satisfying the formulae (1) and (2):

$$Ra \geqq 0.5 \quad (1)$$

$$Rb \geqq (Ra+Rc)/3.0 \quad (2)$$

wherein Rc represents a ratio of absorbance at 765 $cm^{-1}$ of α-type crystal to that at 843 $cm^{-1}$ of β-type crystal at the center point of a fiber cross-section, Rb represents a ratio of absorbance at 765 $cm^{-1}$ of α-type crystal to that at 843 $cm^{-1}$ of β-type crystal at the point of r/3 from the center point thereof, and Ra represents a ratio of absorbance at 765 $cm^{-1}$ of α-type crystal to that at 843 $cm^{-1}$ of β-type crystal at the point of 2r/3 from the center point thereof, wherein r is a radius of the fiber cross-section.

In a second aspect of the present invention, there is provided a vinylidene fluoride resin fiber having a diameter of not less than 0.5 mm, an energy at break per unit sectional area as measured at a pulling rate of 6 m/sec of not less than 4,000 kg/cm, and a tensile strength as measured at a pulling rate of 0.005 m/sec of not less than 50 $kg/mm^2$.

In a third aspect of the present invention, there is provided a process for producing a vinylidene fluoride resin fiber having a diameter of not less than 0.5 mm and satisfying the formulae (1) and (2):

$$Ra \geqq 0.5 \quad (1)$$

$$Rb \geqq (Ra+Rc)/3.0 \quad (2)$$

wherein Rc represents a ratio of absorbance at 765 $cm^{-1}$ of α-type crystal to that at 843 $cm^{-1}$ of β-type crystal at the center point of a fiber cross-section, Rb represents a ratio of absorbance at 765 $cm^{-1}$ of α-type crystal to that at 843 $cm^{-1}$ of β-type crystal at the point of r/3 from the center point thereof, and Ra represents a ratio of absorbance at 765 $cm^{-1}$ of α-type crystal to that at 843 $cm^{-1}$ of β-type crystal at the point of 2r/3 from the center point thereof, wherein r is a radius of the fiber cross-section, which comprises melt-spinning a vinylidene fluoride resin, cooling the spun filament at an ambient temperature of 60° to 140° C. to obtain an unstretched filament, preheating the unstretched filament at an ambient temperature of 70° to 140° C. and then stretching the resultant filament.

In a fourth aspect of the present invention, there is provided a process for producing a vinylidene fluoride resin fiber having a diameter of not less than 0.5 mm, an energy at break per unit sectional area as measured at a pulling rate of 6 m/sec of not less than 4,000 kg/cm and a tensile strength as measured at a pulling rate of 0.005 m/sec of not less than 50 $kg/mm^2$, which comprises melt-spinning a vinylidene fluoride resin, cooling the spun filament at an ambient temperature of 60° to 140° C. to obtain an unstretched filament, preheating the unstretched filament at an ambient temperature of 70° to 140° C. and then stretching the resultant filament.

DETAILED DESCRIPTION OF THE INVENTION

First, the vinylidene fluoride resin fiber (hereinafter referred to as fiber A) provided in the first aspect of the present invention is described.

As the vinylidene fluoride resin constituting the fiber A, there can be used, in addition to homopolymers of vinylidene fluoride, copolymers of vinylidene fluoride with other monomers and mixtures of such polymers. Other monomers copolymerizable with vinylidene fluoride and usable in the present invention include vinyl fluoride, ethylene trifluoride, ethylene trifluorochloride, ethylene tetrafluoride, propylene hexafluoride and the like. These monomers may be used either singly or as a mixture of two or more of them.

In the copolymers of vinylidene fluoride and other monomers, the content of vinylidene fluoride units is usually not less than 70 mol%. The vinylidene fluoride resin used in the present invention may be mixed with other resin(s), plasticizer, inorganic filler, etc., which have compatibility with the said vinylidene fluoride resin, as far as the properties of the said vinylidene fluoride resin is not influenced. In the present invention, copolymer of vinylidene fluoride and propylene hexafluoride is more preferred.

Inherent viscosity (ηinh) of the vinylidene fluoride resin used in the present invention is usually not less than 1.30 dl/g, preferably in a range of 1.35 to 2.00 d1/g, more preferably 1.40 to 1.80 d1/g.

The diameter of fiber A is not less than 0.5 mm, preferably 0.5 to 5 mm, more preferably 1 to 3 mm. The greatest feature of fiber A resides in crystal structure of the fiber cross-section. It is essential, for the reason set forth below, that fiber A satisfies the following requirement specified by the formulae (1) and (2), wherein R represents a ratio (α/β) of absorbance at 765 $cm^{-1}$ of α-type crystal to that at 843 $cm^{-1}$ of β-type crystal, r is a radius of the fiber cross-section, Rc represents a ratio of absorbance at 765 $cm^{-1}$ of α-type crystal to that at 843 $cm^{-1}$ of β-type crystal at the center point of a fiber cross-section, Rb represents a ratio of absorbance at 765 $cm^{-1}$ of α-type crystal to that at 843 $cm^{-1}$ of β-type crystal at the point of r/3 from the center point thereof, and Ra represents a ratio of absorbance at 765 $cm^{-1}$ of α-type crystal to that at 843 $cm^{-1}$ of β-type crystal at the point of 2r/3 from the center point thereof.

The fiber used for fishery materials is required to have various specific properties as mentioned above. Tensile elongation and tensile tenacity (=tensile strength×cross section of the fiber) are also important factors for the said fiber. The tensile elongation is a property that serves for mitigating the impact force transmitted to the fiber when landing a fish, and for also giving flexibility to the fiber. The fiber with high tensile elongation can serve as fiber for fishery materials with excellent handling qualities. The tensile tenacity is a property giving influence on fiber cut. The fiber with high tensile tenacity enables landing of weighty fishes such as tuna with no fear of snapping.

The tensile tenacity of fiber is given as a product of the tensile strength and sectional area of fiber, so that high tensile tenacity can be obtained by elevating tensile strength or by enlarging sectional area of fiber (enlarging the fiber diameter). The high tensile tenacity is essential for fiber to be used for fishery materials, especially for longline. The fiber diameter is enlarged for obtaining a high tensile tenacity, but it is also necessary to increase tensile strength for providing a further greater tensile tenacity.

However, there is yet available no vinylidene fluoride resin fiber which is more than 0.5 mm in diameter and has a satisfactory tensile elongation, particularly one which has both excellent tensile elongation and high tensile strength.

As a result of the studies on crystal structure of vinylidene fluoride resin fiber by the present inventors, the following notable facts have been found.

In the β-type crystal structure in which the orientated crystal system assumes a planar zigzag structure, the tension in the direction of orientation is high, and accordingly the tension in the direction of orientation in the amorphous portion is usually high, too. In case where the tension in the direction of orientation is too high the effect of uniformly supporting the external force between the molecular chains is lowered. On the other hand, in the case of α-type crystal structure in which the orientated crystal system assumes a ½ helical molecular structure, since the tension in the direction of orientation is less than that in the β-type crystal structure, this α-type crystal structure has a proper degree of elongation and can absorb the external force. Therefore, in the vinylidene fluoride resin fiber, the α-type crystal structure is more advantageous than the β-type crystal structure in terms of the tensile elongation, and it is thus necessary to specify the α/β ratio of the crystal structure of fiber in a proper range.

The parameters of fiber A according to the present invention have been determined based on the above finding. Fiber A abounds in α-type crystal structure as compared with conventional vinylidene fluoride resin fibers, and in its sectional structure, the percentage of β-type crystal structure elevates as the distance from the surface layer increases toward the center. The fiber A also satisfies the above-shown formula (2). Consequently, these are indicative of high tensile elongation and tensile strength of fiber A. Also, in fiber A, Ra falls preferably in a range of 0.5 to 1.3, more preferably 0.6 to 1.0. That is, the greater the value of Ra (namely, the higher the percentage of α-type crystal), the higher is tensile elongation, and conversely, the smaller the value of Ra (namely, the higher the percentage of β-type crystal), the higher is tensile strength. Thus for providing a proper combination of tensile elongation and tensile strength, the above-defined range of Ra is recommended. Rc is preferably in a range of 0.02 to 1.0, more preferably 0.02 to 0.5, even more preferably 0.02 to 0.2. As viewed above, an increase of the percentage of β-type crystal leads to an enhancement of tensile strength, but when the fiber is overstretched, Rc approaches to 0 infinitely, micro-voids are formed in the fiber crystal structure, thereby reducing tensile strength of the fiber. In view of this, Rc is preferable not less than 0.02.

The above-said absorbance ratio (α/β) can be determined in the manner described below using a microscopic analyzer FT-IR (Fourier's transform infrared spectrometer). First, the fiber is cut crosswise orthogonally to the longitudinal direction by a microtome to obtain a 10 μm-thick disc-like specimen. Then the radius of the disc-like specimen is trisected, with the center point being indicated by c, the point at ⅓ of the radius from the center point c toward the periphery being indicated by b, and the point at ⅔ of the radius being indicated by a. IR spectrum in an area of circle having 25 μm in radius round each the said measuring point is measured by the microscopic analyzer FT-IR mentioned above. From the chart thus obtained, absorbance (an) of absorption (765 $cm^{-1}$) due to α-type crystal and absorbance (bn) of absorption (843 $cm^{-1}$) due to β-type crystal are determined, and the absorbance ratio (α/β=an/bn) at each point, namely Rc, Rb and Ra are calculated.

In fiber A, it is preferable to hold crystallinity at a low level, specifically in a range of 25 to 55%, preferably 30 to 45%. By holding the crystallinity low, it is possible to impart so-called rubber-like properties to the fiber, enabling even greater tensile elongation.

The crystallinity is determined from the amount of heat of fusion (fusion enthalpy) by the method described below and represented by a value calculated on the assumption that all of the crystals are α-type crystal of polyvinylidene fluoride. First, using a differential scanning calorimeter (DSC), the amount of heat of fusion X (joule/g) of the specimen (10 mg) is measured by heating the specimen at a rate of 10° C./min, and then crystallinity (%) is calculated from the formula: 100·X/93.7, based on the numerical value 1,435 cal/mol (93.7 joule/g) of the amount of heat of fusion of α-type crystal of polyvinylidene fluoride reported by K. Nakagawa and Y. Ishidain J. Polymer Sci. Phys. 11, 2,153 (1973).

Now, the vinylidene fluoride resin fiber (hereinafter referred to as fiber B) provided in a second aspect of the present invention is described. The vinylidene fluoride resin constituting fiber B is the same as that of fiber A described above.

The diameter of fiber B is not less than 0.5 mm, preferably 0.5 to 5 mm, more preferably 1 to 3 mm. The feature of fiber B is that it is specified in energy at break par unit sectional area and in tensile strength. That is, for the reason set forth below, it is essential for fiber B that its energy at break per unit sectional area as measured at a pulling rate of 6 m/sec is not less than 4,000 kg/cm, preferably 4,000 to 7,000 kg/cm, and tensile strength measured at a pulling rate of 0.005 m/sec is not less than 50 $kg/mm^2$, preferably 50 to 80 $kg/mm^2$.

As mentioned above, the tensile tenacity is a property giving influence on fiber cut, and fiber with high tensile tenacity provides a fishline that can land weighty fishes such as tuna without cut. On the other hand, as also mentioned above, in the case of fiber used for catching weighty fishes, a large impact force is given to the fiber, so that it is necessary to incorporate a measure for preventing cut by such an impact force, and from such a viewpoint, fiber B is specified to have energy at break in the defined range.

it is also notable that fiber B whose initial modulus is defined to be not more than 200 kg/mm$^2$, has high flexibility and good workability, and is therefore suited for use as fiber for fishery materials having a diameter not less than 0.5 mm. The preferred range of initial modulus of fiber B is 150 to 180 kg/mm$^2$. Such fiber B has far less probability of cut than the conventional vinylidene fluoride resin fiber because of higher energy at break and tensile strength, and also, in use as fishline, exhibits good handling property when landing a fish. Further, fiber B can have the specified values of Ra and Rb defined by the above-shown formulae (1) and (2) at the same time.

The fiber producing process according to the present invention is now described. Both fiber A and fiber B of the present invention can be produced according to the process comprising melt-spinning a vinylidene fluoride resin, cooling the spun filament at an ambient temperature of 60° to 140° C., preheating the thus obtained unstretched filament at an ambient temperature of 70° to 140° C. and then stretching the filament.

The nozzle temperature for melt spinning is usually 200 to 350° C., preferably 220° to 300° C. The ambient temperature for cooling is preferably 90° to 100° C., and the ambient temperature for preheating is preferably 80° to 125° C. The ambient temperature for stretching is usually 130° to 175° C., preferably 140° to 170° C. The stretching ratio is usually 4.5 to 8.0 times, preferably 5 to 6.5 times. The relaxation temperature is usually 80° to 180° C. and the relaxation percentage is usually selected from the range of 5 to 20%. Cooling and preheating may be performed in one step.

The said cooling, preheating and stretching treatments are conducted in a bath of a suitable size using a heating medium which is chemically inert to the vinylidene fluoride resin, such as silicone oil, liquid paraffin, glycerin or the like, while the relaxation treatment is carried out in dry heat, for example, in an inert gas heated to a prescribed temperature. Stretching may be performed either in a single stage or in multiple stages.

Generally, in fiber having a diameter not less than 0.5 mm, heat is not well transmitted throughout the whole fiber, and in the fiber cross-section, the ratio of α-type crystal structure to β-type crystal structure (α/β ratio) tends to lower as the distance from the surface increases toward the center. Also, the α/β ratio is hardly uniformalized. throughout the fiber cross-section. Therefore, for obtaining a fiber (especially fiber A) of the present invention, it is necessary to perform the said treatments in such a manner that heat will be uniformly transmitted throughout the whole fiber. For this purpose, it is imperative to operate the melt extruder at a low extrusion rate while properly selecting the bathing time for the said treatments. For example, the preferable bathing time for cooling is usually 30 to 200 seconds, more preferable 10 to 60 seconds. The same method is performed for production of the fiber B of the present invention.

By selecting these production conditions, it is possible to prevent formation of microscopic unevenness on the fiber surface and microscopic voids in the inside of the fiber, and the fiber A and fiber B of the present invention obtained under these conditions have very excellent transparency, with the parallel ray transmittance in water being not less than 28%.

The said fiber A or B can be most advantageously used as fiber for fishery materials. Particularly fiber whose parallel ray transmittance is not less than 28% is preferable for application to fishery materials. By using such fiber, a high fish catch can be obtained. As mentioned above, the vinylidene fluoride resin fiber has a refractive index close to that of water and is hardly visible in water, and for this reason, popularly used as fiber or fishery materials. For making this fiber even harder to see in water, it is imperative to increase its transparency in water, in other words, to elevate its parallel ray transmittance in water. This is of particular significance for fiber having a diameter not less than 0.5 mm. According to the present invention, there are provided a vinylidene fluoride resin fiber which is particularly useful as fishline for landing weighty-fishes such as tuna, and a process for producing such fiber.

EXAMPLES

The present invention is described in further detail below with reference to the examples thereof, and the examples are merely intended to be illustrative and not to be construed as limiting the scope of the invention in any way.

In the following Examples, property determinations of the obtained fibers were made by the methods described below.

(1) Absorbance Ratio R (α/β) and Crystallinity

Measured by the method described above. The average of five specimens was given as the values.

(2) Tensile Elongation and Tensile Strength

Measured by the following method using a tensile testing machine (TENSILON UTM-III-100 mfd. by Olientech Co., Ltd.). First, from a single piece of sample fiber, there were collected 10 one-meter-long test fiber specimens at intervals of approximately 5 meters. Both ends of each test fiber specimen were fixed by coiling them 3 turns around a 13 mmϕ round bar which is a fixture of the tensile testing machine, and setting the test length at 300 mm, tensile elongation and tensile strength of the specimen were measured under the conditions of 23° C., 60% RH and a pulling rate of 300 mm/min. The each average of 10 specimens was calculated and shown.

(3) Energy at Break Per Unit Sectional Area

Measured by the following method using an instrumentated impact tester (TENSILON UTM-5 mfd. by Olientech Co., Ltd.). From a single piece of fiber, there were collected 10 one-meter long test fiber specimens at intervals of approximately 5 meters. Both ends of each test fiber specimen were fixed by coiling them 3 turns around a 13 mmϕ round bar which is a fixture of the impact tester, and setting the test length at 300 mm, energy at break of the specimen was measured under the conditions of 23° C., 60% RH and a pulling rate of 6 m/sec. The thus measured energy at break was divided by the sectional area of the fiber to determine energy at break per unit sectional area. The average of 10 specimens was calculated and shown.

(4) Parallel Ray Transmittance

A single piece of fiber was cut into 43-mm long pieces. These pieces were arranged side by side in a row so that the array would have a width of approximately 36 mm, and both ends of the array were fixed by a tape to prepare a test specimen. This specimen was put into a liquid measuring quartz cell (internal dimensions: 43 mm×36 mm×10 mm) containing distilled water so that with the inner surface into contact with the inner surface of the cell on one side. The cell was set in a cloudiness meter (Σ80 mfd. by Nippon Denshoku Kogyo Co., Ltd) and parallel ray transmittance of the specimen in water was measured according to JIS K 7105.5 by using a standard-light source defined in JIS Z 8720

Example 1

Using a melt extruder having an 8 mmϕ nozzle, pellets of a copolymer obtained from 92 parts by weight of vinylidene fluoride and 8 parts by weight of propylene hexafluoride and having an inherent viscosity of 1.47 were melt spun at a nozzle temperature of 265° C. and introduced into a 105° C. glycerin bath for gradual cooling to obtain an unstretched filament having a diameter of 4.47 mm. This unstretched filament was preheated in a 95° C. glycerin bath (preheating bath), stretched about 6.4 times in a 150° C. glycerin bath (stretching bath), then relaxed about 12% in dry heat of 130° C. and wound up. In the above operation, the extrusion rate of the melt extruder was 20 g/min, the residence time in the cooling bath was about 90 seconds, the residence time in the preheating bath was about 23 seconds and the residence time in the stretching bath was about 7 seconds. The producing conditions are shown in Table 1 and the results of property determinations of the obtained fiber are shown in Table 2.

Example 2

Using the same extruder as employed in Example 1, pellets comprising 100 parts by weight of a polyvinylidene fluoride resin having an intrinsic viscosity of 1.55 and 6.5 parts by weight of a polyester plasticizer were melt spun at a nozzle temperature of 265° C. and then introduced into a 120° C. glycerin bath for gradual cooling to obtain an unstretched filament having a diameter of 4.30 mm. This unstretched filament was preheated in a 110° C. glycerin bath (preheating bath), stretched about 6.0 times in a 165° C. glycerin bath (stretching bath), relaxed about 13% in dry heat of 140° C. and then wound up. In the above operation, extrusion rate of the melt extruder, residence time in the cooling bath, residence time in the preheating bath and residence time in the stretching bath were all same as in Example 1. The producing conditions are shown in Table 1 and the results of property determinations of the obtained fiber are shown in Table 2.

Example 3

Using a melt extruder having a 9 mmϕ nozzle, pellets of a copolymer obtained from 92 parts by weight of vinylidene fluoride and 8 parts by weight of propylene hexafluoride and having an inherent viscosity of 1.47 were melt spun at a nozzle temperature of 265° C. and introduced into a 112° C. glycerin bath for gradual cooling to obtain an unstretched filament having a diameter of 4.37 mm. This unstretched filament was preheated in a 92° C. glycerin bath (preheating bath), stretched about 6.3 times in a 159° C. glycerin bath (stretching bath), relaxed about 15% in 135° C. dry heat and then wound up. In the above operation, the extrusion rate of the melt extruder was 20 g/min, the residence time in the cooling bath was about 80 seconds, the residence time in the preheating bath was about 20 seconds and the residence time in the stretching bath was about 5 seconds. The producing conditions are shown in Table 1 and the results of property determinations of the obtained fiber are shown in Table 2.

TABLE 1

| | Example 1 | Example 2 | Example 3 |
|---|---|---|---|
| Extrusion rate (g/min) | 20 | 20 | 20 |
| Nozzle temperature (°C.) | 265 | 265 | 265 |
| Cooling temperature (°C.) | 105 | 120 | 112 |
| Preheating temperature (°C.) | 95 | 110 | 92 |
| Preheating bath residence time (sec) | 23 | 23 | 20 |
| Stretching temperature (°C.) | 150 | 165 | 159 |
| Stretching ratio (times) | 6.4 | 6.0 | 6.3 |
| Medium in stretching bath | Glycerin | Glycerin | Glycerin |
| Stretching bath residence time (sec) | 7 | 7 | 5 |
| Relaxing heat treatment temperature (°C.) | 130 | 140 | 135 |
| Relaxation percentage (%) | 12 | 13 | 15 |

TABLE 2

| | Example 1 | Example 2 | Example 3 |
|---|---|---|---|
| Inherent viscosity | 1.47 | 1.55 | 1.47 |
| Fiber diameter (mm) | 1.87 | 1.88 | 1.74 |
| Crystallinity (%) | 36 | 53 | 37 |
| α/β | | | |
| Ra | 1.25 | 1.15 | 0.80 |
| Rb | 0.86 | 0.80 | 0.42 |
| Rc | 0.20 | 0.35 | 0.05 |
| Energy at break (kg/cm) | 58000 | 48000 | 52000 |
| Tensile strength (kg/mm$^2$) | 58 | 63 | 61 |
| Tensile elongation (%) | 67 | 60 | 90 |
| Modulus (kg/mm$^2$) | 170 | 190 | 180 |
| Parallel ray transmittance (in water: %) | 32 | 29 | 33 |

(Note) The energy at break is the value per unit sectional area of the fiber.

Comparative Example 1

Using the same extruder as employed in Example 1, pellets of a polyvinylidene fluoride resin having an inherent viscosity of 1.00 were melt spun at a nozzle temperature of 250° C. and introduced into a 110° C. glycerin bath for gradual cooling to obtain an unstretched filament having a diameter of 3.96 mm. This unstretched filament was stretched about 5.5 times in a 100° C. steam bath (stretching bath), then relaxed about 15% in 150° C. dry heat and wound up. In the above operation, the extrusion rate of the melt extruder was 21 g/min, the residence time in the cooling bath was about 90 minutes and the residence time in the stretching bath was the same as in Example 1. The producing conditions are shown in Table 3 and the results of property determinations of the obtained fiber are shown in Table 4.

Comparative Example 2

Using the same extruder as employed in Example 1, pellets comprising 100 parts by weight of a polyvinylidene fluoride resin having an inherent viscosity of 1.20 and 5.0 parts by weight of a polyester plasticizer were melt spun at a nozzle temperature of 250° C. and introduced into a 70° C. hot water bath for gradual cooling to obtain an ungrafted filament having a diameter of 4.61 mm. This ungrafted filament was stretched about 6.3 times in a 100° C. steam bath (stretching bath), relaxed about 10% in 150° C. dry heat and wound up. In the above operation, the extrusion rate of the melt extruder was 24 g/min, the residence time in the cooling bath was about 80 seconds and the residence time in the stretching bath was the same as in Example 1. The producing conditions are shown in Table 3 and the results of property determinations of the obtained fiber are shown in Table 4.

TABLE 3

| | Comparative Example 1 | Comparative Example 2 |
|---|---|---|
| Extrusion rate (g/min) | 21 | 24 |
| Nozzle temperature (°C.) | 250 | 250 |
| Cooling temperature (°C.) | 110 | 70 |
| Preheating temperature (°C.) | — | — |
| Preheating bath residence time (sec) | — | — |
| Stretching temperature (°C.) | 100 | 100 |
| Stretching ratio (times) | 5.5 | 6.3 |
| Medium in stretching bath | Steam | Steam |
| Stretching bath residence time (sec) | 7 | 7 |
| Relaxing heat treatment temperature (°C.) | 150 | 150 |
| Relaxation percentage (%) | 15 | 10 |

TABLE 4

| | Comparative Example 1 | Comparative Example 2 |
|---|---|---|
| Fiber diameter (mm) | 1.83 | 1.95 |
| Crystallinity (%) | 57 | 57 |
| α/β | | |
| Ra | 1.50 | 0.62 |
| Rb | 0.27 | 0.20 |
| Rc | 0.24 | 0.01 |
| Energy at break (kg/cm) | 43000 | 38000 |
| Tensile strength (kg/mm$^2$) | 29 | 37 |
| Tensile elongation (%) | 44 | 36 |
| Modulus (kg/mm$^2$) | 230 | 190 |
| Parallel ray transmittance (in water: %) | 27 | 25 |

(Note) Energy at break is the value per unit sectional area of the fiber.

What is claimed is:

1. A vinylidene fluoride resin fiber having a diameter of not less than 0.5 mm, and satisfying the formulae (1) and (2):

$$Ra \geqq 0.5 \quad (1)$$

$$Rb \geqq (Ra+Rc)/3.0 \quad (2)$$

wherein Rc represents a ratio of absorbance at 765 cm$^{-1}$ of α-type crystal to that at 843 cm$^{-1}$ of β-type crystal at the center point of a fiber cross-section, Rb represents a ratio of absorbance at 765 cm$^{-1}$ of α-type crystal to that at 843 cm$^{-1}$ of β-type crystal at the point of r/3 from the center point thereof, and Ra represents a ratio of absorbance at 765 cm$^{-1}$ of α-type crystal to that at 843 cm$^{-1}$ of β-type crystal at the point of 2r/3 from the center point thereof, wherein r is a radius of the fiber cross-section.

2. A vinylidene fluoride resin fiber according to claim 1, wherein the vinylidene fluoride resin is a copolymer of vinylidene fluoride and propylene hexafluoride.

3. A vinylidene fluoride resin fiber having a diameter of not less than 0.5 mm, an energy at break per unit sectional area as measured at a pulling rate of 6 m/sec of 48,000 to 58,000 kg/cm, and a tensile strength as measured at a pulling rate of 0.005 m/sec of not less than 50 kg/mm$^2$.

4. A vinylidene fluoride resin fiber according to claim 3, wherein the tensile strength as measured at a pulling rate of 0.005 m/sec is 50 to 80 kg/mm$^2$.

5. A vinylidene fluoride resin fiber according to claim 3, wherein the initial modulus thereof is not more than 200 kg/mm$^2$.

6. A vinylidene fluoride resin fiber according to claim 3, which satisfies the formulae (1) and (2):

$$Ra > 0.5 \quad (1)$$

$$Rb > (Ra+Rc)/3.0 \quad (2)$$

wherein Rc represents a ratio of absorbance at 765 cm$^{-1}$ of α-type crystal to that at 843 cm$^{-1}$ of β-type crystal at the center point of a fiber cross-section, Rb represents a ratio of absorbance at 765 cm$^{-1}$ of α-type crystal to that at 843 cm$^{-1}$ of β-type crystal at the point of r/3 from the center point thereof, and Ra represents a ratio of absorbance at 765 cm$^{-1}$ of α-type crystal to that at 843 cm$^{-1}$ of β-type crystal at the point of 2r/3 from the center point thereof, wherein r is a radius of the fiber cross-section.

7. A vinylidene fluoride resin fiber according to claim 3, wherein the vinylidene fluoride resin is a copolymer of vinylidene fluoride and propylene hexafluoride.

* * * * *